US008907274B2

(12) United States Patent
Mizutani

(10) Patent No.: US 8,907,274 B2
(45) Date of Patent: Dec. 9, 2014

(54) QUADRUPOLE MASS SPECTROMETER

(75) Inventor: Shiro Mizutani, Kyoto (JP)

(73) Assignee: Shimadzu Corporation, Kyoto-Shi (JP)

( * ) Notice: Subject to any disclaimer, the term of this patent is extended or adjusted under 35 U.S.C. 154(b) by 0 days.

(21) Appl. No.: 13/983,498

(22) PCT Filed: Feb. 10, 2011

(86) PCT No.: PCT/JP2011/052930

§ 371 (c)(1),
(2), (4) Date: Aug. 2, 2013

(87) PCT Pub. No.: WO2012/108050

PCT Pub. Date: Aug. 16, 2012

(65) Prior Publication Data

US 2013/0313427 A1 Nov. 28, 2013

(51) Int. Cl.

*H01J 49/00* (2006.01)
*H01J 49/42* (2006.01)
*H01J 49/02* (2006.01)

(52) U.S. Cl.

CPC ..... *H01J 49/4215* (2013.01); *H01J 49/022* (2013.01); *H01J 49/421* (2013.01)
USPC ..... 250/290; 250/281; 250/282; 250/288

(58) Field of Classification Search

CPC ... H01J 49/4215; H01J 49/421; H01J 49/063; H01J 49/26; H01J 49/022
USPC ..... 250/281, 282, 283, 286, 288, 289, 290, 250/294
See application file for complete search history.

(56) References Cited

U.S. PATENT DOCUMENTS

2006/0016985 A1* 1/2006 Roushall et al. ..... 250/292
2009/0114810 A1* 5/2009 Green ..... 250/282

FOREIGN PATENT DOCUMENTS

JP A1069880 8/1996
JP A200077025 3/2000
WO WO-2010023706 4/2010

OTHER PUBLICATIONS

International Search Report for PCT/JP2011/052930 mailed May 17, 2011, 2 pages.

* cited by examiner

*Primary Examiner* — Nicole Ippolito
*Assistant Examiner* — Hanway Chang
(74) *Attorney, Agent, or Firm* — Bingham McCutchen LLP

(57) ABSTRACT

A quadrupole power source which applies a voltage to each electrode (2*a*-2*d*) of a quadrupole mass filter (2) receives inputs of an m/z-axis correction coefficient Mcomp1 and a V-voltage correction coefficient Vcomp1 in addition to a power supply controlling voltage Qcont according to the m/z of a target ion. Vcomp1 is a reciprocal of the ratio by which a frequency is changed, while Mcomp1 is the square of the ratio by which the frequency is changed. In a detection gain adjuster section (4C), a multiplier (421) multiplies an output Vdet' of a V-voltage adjusting amplifier (405) by Vcomp1, whereby the radio-frequency voltage produced by a radio-frequency power supply section (4A) is maintained at the same level even when the set frequency of a signal generator (411) is changed in order to tune an LC resonance circuit.

3 Claims, 9 Drawing Sheets f=1.2MHz: PEAKS ADJUSTED f=1.20024MHz: WITHOUT VOLTAGE ADJUSTMENT f=1.20024MHz: WITH V-VOLTAGE ADJUSTMENT f=1.20024MHz: WITH U-VOLTAGE ADJUSTMENT

QUADRUPOLE MASS SPECTROMETER

TECHNICAL FIELD

The present invention relates to a quadrupole mass spectrometer using a quadrupole mass filter as a mass separator for separating ions according to their mass-to-charge ratios m/z.

BACKGROUND ART

Quadrupole mass spectrometers are a type of mass spectrometer in which a quadrupole mass filter is used for separating ions according to their mass-to-charge ratios. FIG. 6 shows a schematic configuration of a quadrupole mass spectrometer. Various kinds of ions produced in an ion source 1 are introduced through an ion transport optical system (not shown) into a quadrupole mass filter 2 composed of four rod electrodes 2*a*, 2*b*, 2*c* and 2*d*. Voltages±(U+V cos ωt) produced by superimposing radio-frequency (RF) voltages±V cos ωt on direct-current (DC) voltages±U are applied from a quadrupole power source 4 to the four rod electrodes 2*a*-2*d*. Only the ions having a specific mass-to-charge ratio corresponding to those voltages are selectively allowed to pass through the quadrupole mass filter 2. The ions which have passed through are detected by a detector 3, which acquires a detection signal corresponding to the amount of ions.

For example, when a scan measurement over a predetermined range of mass-to-charge ratios is performed, a controller 5 operates the quadrupole power source 4 so that the amplitude value V of the RF voltage V cos ωt and the value U of the DC voltage independently change while maintaining a specific relationship. By this control, the mass-to-charge ratio of the ions passing through the quadrupole mass filter 2 is continuously varied over a predetermined range of mass-to-charge ratios. Based on the detection signals acquired by the detector 3 during this scan, a data processor 6 creates a mass spectrum with the horizontal axis indicating the mass-to-charge ratio and the vertical axis indicating the ion intensity.

FIG. 7 is a schematic block diagram of a commonly used conventional quadrupole power source 4 (see Patent Documents 1 and 3). Coils 10 and 12 with inductance L and capacitors 11 and 13 with capacitance C' are connected to the output of the quadrupole power source 4. The capacitance C in the rod electrodes 2*a*-2*d* is composed of the capacitances C' of the capacitors 11 and 13 combined with the stray capacitance of the rod electrodes 2*a*-2*d*. The serial circuit of the combined capacitance C and the aforementioned inductance L functions as an LC resonance circuit. A resonance in this LC resonance circuit produces an RF voltage, which is to be superimposed on the DC voltage and applied to the rod electrodes 2*a*-2*d*. For example, the frequency of the RF voltage produced by the quadrupole power source 4 and supplied into the LC resonance circuit is f=1.2 MHz.

The condition for the resonance in the LC resonance circuit is $f=1/(2\pi\sqrt{LC})$. There are the following two methods for satisfying this condition and creating a resonance: (1) the frequency f of the supplied RF voltage is fixed, and either the inductance of the coils 10 and 12 or the capacitance of the capacitors 11 and 13 is adjusted to tune the circuit and create an LC resonance; or (2) the inductance of the coils 10 and 12 as well as the capacitance of the capacitors 11 and 13 are fixed, and the frequency f of the supplied RF voltage is adjusted to tune the circuit and create an LC resonance. Method (1) has the problem that it requires expensive components for accurately varying the inductance of the coils 10 and 12 or the capacitance of the capacitors 11 and 13, and that it is in some cases difficult to ensure a stable performance due to a variation in the characteristics of the components. Therefore, in many cases, the frequency-variable tuning method as described in (2) is used. However, a quadrupole power source using the conventional frequency-variable tuning method has the following problem.

FIG. 8 shows the circuit configuration of a quadrupole power source 4 in which a commonly used conventional frequency-variable tuning method is adopted (see Patent Documents 1 and 2). In this circuit, a wave detector section 4D, which includes a diode bridge rectifier circuit 401 as well as detecting capacitors 402 and 403, detects the voltage value of the RF voltage applied to the quadrupole mass filter 2 (this value is hereinafter called the "V voltage"). The detection output is converted into a DC voltage and is fed back to an RF power supply section 4A and a DC power supply section 4B via a detection gain adjuster section 4C. The detection gain adjuster section 4C includes a V-voltage detecting resistor 404, a V-voltage adjusting amplifier 405 and a V-voltage adjusting variable resistor 406. The RF power supply section 4A includes a buffer amplifier 407, an m/z-axis adjusting variable resistor 408, a V-voltage comparing amplifier 409, a multiplier 410, an RF voltage signal generator 411, a buffer amplifier 412, a drive circuit 413 and an RF transformer 414. The DC power supply section 4B includes an inverting amplifier 415, a positive DC voltage amplifier 416 and a negative DC voltage amplifier 417.

The frequency f of the RF voltage supplied from the secondary coil of the RF transformer 414 to the LC resonance circuit including the quadrupole mass filter 2 is determined by the frequency of the rectangular signal generated by the RF voltage signal generator 411. The voltage value of that RF voltage in turn is determined by the voltage given from the V-voltage comparing amplifier 409 to the multiplier 410. The output voltage of the V-voltage comparing amplifier 409 depends on the detection output fed back from the wave detector section 4D, the power supply controlling voltage (Qcont) corresponding to the target mass-to-charge ratio given from the controller 5, the adjusting positions of the V-voltage adjusting variable resistor 406 and the m/x-axis adjusting variable resistor 408, and other factors.

The V-voltage adjusting variable resistor 406 has the function of adjusting the gain for amplifying the detection output fed back from the wave detector section 4D. A detection output voltage is amplified by the V-voltage adjusting amplifier 405 with the gain set by this resistor 406 and sent to a comparator for setting the V voltage, which consists of the m/z-axis adjusting variable resistor 408 and the V-voltage comparing amplifier 409, as well as to the DC power supply section 4B. The comparator for setting the V voltage, which consists of the m/z-axis adjusting variable resistor 408 and the V-voltage comparing amplifier 409, has the function of comparing the detection output after the gain adjustment with the power supply controlling voltage and determining the multiplier factor (or as it were, gain) of the multiplier 410 according to the comparison result.

The circuit of the quadrupole power source 4 operates in such a manner that a V-voltage monitoring voltage Vmon, which is the output of the V-voltage adjusting amplifier 405, is constantly maintained at the same level when the power supply controlling voltage Qcont is constant. Accordingly, the following relationships hold true.

[*V*-voltage monitoring voltage *Vmon*] ∝

[*V*-voltage detecting voltage *Vdet*] =

-continued $$[\text{Current } i \text{ passing through the detecting capacitor 402 or 403}] \times [\text{Resistance } R \text{ of the } V\text{-voltage detecting resistor 404}] \propto [V \text{ voltage}] \times 2\pi f \times [\text{Capacitance } C \text{ of the detecting capacitor 402 or 403}] \times [\text{Resistance } R \text{ of the } V\text{-voltage detecting resistor}] \propto [V \text{ voltage}] \cdot f$$

That is to say, in the circuit of the quadrupole power source 4 shown in FIG. 8, the V voltage is inversely proportional to the frequency f. Therefore, for example, the higher frequency f is, the lower the V voltage is. This means that, in the frequency-variable tuning method, the V voltage changes when the frequency of the RF voltage is changed for the purpose of tuning. For example, a 0.2% increase in the frequency f (from 1.2 MHz to 1.20024 MHz) causes a 0.2% decrease in the V voltage. This causes a change in the UN ratio, despite the fact that this ratio should be maintained at the same value. As a result, the mass-resolving power becomes higher (and the sensitivity becomes lower) than it should be within a high mass-to-charge ratio range.

FIGS. 9A and 9B are examples of peak profiles actually measured at a plurality of mass-to-charge ratios for a standard sample, where FIG. 9A shows the result obtained when the frequency f was optimally adjusted to 1.2 MHz, and FIG. 9B shows the result obtained when the frequency f was slightly increased from the state of FIG. 9A to 1.20024 MHz (without voltage adjustment). A comparison of FIGS. 9A and 9B demonstrates that the peaks in FIG. 9B have smaller half-value widths and lower peak values within a range where the mass-to-charge ratio is high. This means that the mass-resolving power is improved while the detection sensitivity is lowered.

According to the Mathieu equation which is used for analyzing the stability of an ion in a quadrupole electric field, as expressed by the following equation (1), when the frequency f of the RF voltage is changed, an optimal voltage for an arbitrary mass-to-charge ratio must be changed by a ratio equal to the square of the frequency change.

$$au = ax = -ay = 4eU/(m\omega^2 r_0^2)$$

$$qu = qx = -qy = 2eU/(m\omega^2 r_0^2) \quad (1)$$

For example, in the aforementioned case where the frequency f is increased by 0.2%, the optimal value of the V voltage or the U voltage will be the V voltage (or U voltage) at frequency f=1.20024 MHz multiplied by $(1.20024/1.2)^2$. Accordingly, for an increase in the frequency f, if the V voltage is merely raised by the amount of decrease which accompanies the increase in the frequency to readjust the V voltage to its original level, a displacement of the m/z axis occurs. FIG. 10A is an example of the actual measurement in which the V voltage was readjusted from the state of FIG. 9B to the original level. A displacement of the m/z axis can be seen in the figure.

Furthermore, a displacement of the m/z axis also occurs when the U voltage is changed so as to maintain the U/V ratio at the same value. FIG. 10B is an example of the actual measurement which further included the step of adjusting the U voltage to bring the U/V ratio from the state of FIG. 10A back to the intended value. Again, a displacement of the m/z axis can be seen.

What is evident from the foregoing explanations is that, if the frequency-variable tuning method is adopted, it is necessary to adjust the mass-resolving power and the m/z axis by performing a manual adjustment or automatic tuning of the variable resistors 406 and 408 every time the frequency of the RF voltage is changed for the purpose of tuning

BACKGROUND ART DOCUMENT

Patent Document

Patent Document 1: JP-A 10-69880
Patent Document 2: JP-A 2000-77025
Patent Document 3: WO 2010/023706

SUMMARY OF THE INVENTION

Problem to be Solved by the Invention

Thus, although the frequency-variable tuning method can achieve a stable operation since it requires no tuning through the adjustment of the parameters of the inductance elements and the capacitance elements constituting the LC resonance circuit, a problem exists in that the method requires the cumbersome tasks of the mass-resolving power adjustment and the m/z axis adjustment (accuracy adjustment), which not only imposes a significant workload on operators but also lowers the efficiency of the analytical work.

The present invention has been developed to solve such a problem, and its primary objective is to provide a quadrupole mass spectrometer including a quadrupole power source in which a frequency-variable tuning method is adopted and yet no cumbersome task of adjusting the mass-peak shape or the m/z axis by an adjustment or automatic tuning of variable resistors and other elements is required when the frequency is changed for the purpose of tuning.

Means for Solving the Problems

The first aspect of the present invention aimed at solving the aforementioned problem is a quadrupole mass spectrometer including a quadrupole mass filter composed of a plurality of electrodes, a quadrupole power source for applying a predetermined voltage to each of the electrodes of the quadrupole mass filter so as to selectively allow an ion having a specific mass-to-charge ratio to pass through the quadrupole mass filter, and a controller for giving the quadrupole power source an instruction on a target voltage corresponding to the mass-to-charge ratio of a target ion; the quadrupole power source having a wave detector for detecting a radio-frequency voltage applied to the quadrupole mass filter and generating a DC detection output, a detection output adjuster for adjusting the gain of the detection output generated by the wave detector, a radio-frequency power source which includes a signal generator for generating a radio-frequency signal with a variable frequency and which produces a radio-frequency voltage whose amplitude is based on a comparison between an output of the detection output adjuster and the target voltage and whose frequency is equal to or proportional to the frequency of the radio-frequency signal, a direct-current power source for producing a direct-current voltage based on the output of the detection output adjuster, and a superimposer for superimposing the direct-current voltage produced by the direct-current power source and the radio-frequency voltage produced by the radio-frequency power source, where the radio-frequency voltage superimposed by the superimposer is applied to the quadrupole mass filter after being increased by an LC resonation circuit including, as a component thereof, a stray capacitance between the electrodes of the quadrupole mass filter, and where the LC resonance circuit is tuned by adjusting the frequency of the radio-frequency signal, wherein the detection output adjuster in the quadrupole power source includes an amplifier for amplifying a voltage with a constant gain independent of the frequency of the radio-frequency signal and a first corrector for correcting a voltage at a stage of input to or output from the amplifier according to a ratio of a frequency change so that the radio-frequency voltage applied to the quadrupole mass filter maintains a constant amplitude when the frequency of the radio-frequency signal is changed from a standard frequency for the purpose of tuning, and the quadrupole power source further includes a second corrector for correcting the target voltage according to the square of the ratio of the frequency change when the aforementioned frequency change for the tuning is made.

In the quadrupole mass spectrometer according to the first aspect of the present invention, when the frequency of the radio-frequency signal generated in the signal generator is increased, for example, from a standard frequency (the resonance frequency when the stray capacitance of the quadrupole mass filter and other factors are in a supposed ideal state) in order to tune the LC resonance circuit, the first corrector decreases the gain by an amount corresponding to the degree of increase in the frequency. As a result, the overall gain of the detection output adjuster also decreases, which triggers a feedback operation for increasing the output of the radio-frequency voltage so as to cancel the amount of decrease in the gain, whereby the amplitude of the radio-frequency voltage applied to the quadrupole mass filter is maintained at the same level as before the frequency change. Thus, the relationship (ratio) between the amplitude of the radio-frequency voltage applied to the quadrupole mass filter and the direct-current voltage is constantly maintained, so that the mass-resolving power is retained in good condition. The second corrector corrects the target voltage by an amount corresponding to the square of the rate of change due to the frequency increase for the tuning. As a result, an optimal condition for the selection of an ion in accordance with the Mathieu equation is maintained for any mass-to-charge ratio, so that the displacement of the m/z axis will be avoided.

The second aspect of the present invention aimed at solving the aforementioned problem is a quadrupole mass spectrometer including a quadrupole mass filter composed of a plurality of electrodes, a quadrupole power source for applying a predetermined voltage to each of the electrodes of the quadrupole mass filter so as to selectively allow an ion having a specific mass-to-charge ratio to pass through the quadrupole mass filter, and a controller for giving the quadrupole power source an instruction on a target voltage corresponding to the mass-to-charge ratio of a target ion, the quadrupole power source having a wave detector for detecting a radio-frequency voltage applied to the quadrupole mass filter and generating a DC detection output, a detection output adjuster for adjusting the gain of the detection output generated by the wave detector, a radio-frequency power source which includes a signal generator for generating a radio-frequency signal with a variable frequency and which produces a radio-frequency voltage whose amplitude is based on a comparison between an output of the detection output adjuster and the target voltage and whose frequency is equal to or proportional to the frequency of the radio-frequency signal, a direct-current power source for producing a direct-current voltage based on the output of the detection output adjuster, and a superimposer for superimposing the direct-current voltage produced by the direct-current power source and the radio-frequency voltage produced by the radio-frequency power source, where the radio-frequency voltage superimposed by the superimposer is applied to the quadrupole mass filter after being increased by an LC resonation circuit including, as a component thereof, a stray capacitance between the electrodes of the quadrupole mass filter, and where the LC resonance circuit is tuned by adjusting the frequency of the radio-frequency signal, wherein the quadrupole power source includes:

a) a first corrector for correcting an output sent from the detection output adjuster to the direct-current power source according to a ratio of a frequency change so that the ratio between the amplitude of the radio-frequency voltage applied to the quadrupole mass filter and the direct-current voltage is constantly maintained, by changing the output sent from the detection output adjuster to the direct-current power source by an amount corresponding to a change in the output of the radio-frequency power source when the frequency of the radio-frequency signal is changed from a standard frequency for the purpose of tuning; and b) a second corrector for correcting the target voltage according to the cube of the ratio of the frequency change when the aforementioned frequency change for the tuning is made.

In the quadrupole mass spectrometer according to the second aspect of the present invention, when the frequency of the radio-frequency signal generated in the signal generator is increased, for example, from a standard frequency in order to tune the LC resonance circuit, the first corrector corrects the voltage sent from the detection output adjuster to the direct-current power source, so as to decrease the output from the direct-current power source by an amount corresponding to the decrease in the output of the radio-frequency voltage which accompanies the increase in the frequency. As a result, the same relationship (ratio) between the amplitude of the radio-frequency voltage applied to the quadrupole mass filter and the direct-current voltage is maintained as before the frequency change, and the mass-resolving power is retained in good condition. The second corrector corrects the target voltage by an amount corresponding to the cube of the rate of change due to the frequency increase for the tuning. As a result, an optimal condition for the selection of an ion in accordance with the Mathieu equation is maintained for any mass-to-charge ratio, so that the displacement of the m/z axis will be avoided.

In both the first and second aspects of the present invention, a target voltage to be used as an objective value for the radio-frequency voltage is given from the controller to the quadrupole power source, while the direct-current power source produces a direct-current voltage based on a detection output fed back to it. As another possibility, the controller may be configured so that it produces separate target voltages for the radio-frequency voltage and the direct-current voltage at which a constant relationship of the two voltages is maintained, and provides the radio-frequency power source and the direct-current voltage supply with the respective target voltages.

The third aspect of the present invention aimed at solving the aforementioned problem is a quadrupole mass spectrometer including a quadrupole mass filter composed of a plurality of electrodes, a quadrupole power source for applying, to each of the electrodes of the quadrupole mass filter, a predetermined voltage composed of a radio-frequency voltage superimposed on a direct-current voltage so as to selectively allow an ion having a specific mass-to-charge ratio to pass through the quadrupole mass filter, and a controller for giving the quadrupole power source an instruction on a first target voltage relating to the amplitude of the radio-frequency voltage and on a second target voltage relating to the direct-current voltage so that a voltage corresponding to the mass-to-charge ratio of a target ion is applied to the quadrupole mass filter while maintaining a constant relationship between the amplitude of the radio-frequency voltage and the direct-current voltage, the quadrupole power source having a wave detector for detecting a radio-frequency voltage applied to the quadrupole mass filter and generating a DC detection output, a detection output adjuster for adjusting the gain of the detection output generated by the wave detector, a radio-frequency power source which includes a signal generator for generating a radio-frequency signal with a variable frequency and which produces a radio-frequency voltage whose amplitude is based on a comparison between an output of the detection output adjuster and the first target voltage and whose frequency is equal to or proportional to the frequency of the radio-frequency signal, a direct-current power source for producing a direct-current voltage corresponding to the second target voltage, and a superimposer for superimposing the direct-current voltage produced by the direct-current power source and the radio-frequency voltage produced by the radio-frequency power source, where the radio-frequency voltage superimposed by the superimposer is applied to the quadrupole mass filter after being increased by an LC resonation circuit including, as a component thereof, a stray capacitance between the electrodes of the quadrupole mass filter, and where the LC resonance circuit is tuned by adjusting the frequency of the radio-frequency signal, wherein the quadrupole power source includes:

a) a first corrector for correcting the first target voltage according to the cube of a ratio of a frequency change when the frequency of the radio-frequency signal is changed from a standard frequency for the purpose of tuning; and b) a second corrector for correcting the second target voltage according to the square of the ratio of the frequency change when the aforementioned frequency change for the tuning is made.

The first and second correctors in the quadrupole mass spectrometer according to the third aspect of the present invention have substantially the same functions as the first and second correctors in the quadrupole mass spectrometer according to the first or second aspect of the present invention: the same relationship (ratio) between the amplitude of the radio-frequency voltage applied to the quadrupole mass filter and the direct-current voltage is maintained as before the frequency change, and the mass-resolving power is retained. Furthermore, an optimal condition for the selection of an ion in accordance with the Mathieu equation is maintained for any mass-to-charge ratio, whereby the displacement of the m/z axis is avoided.

Effect of the Invention

In any of the quadrupole mass spectrometers according to the first through third aspects of the present invention, when the frequency of the radio-frequency voltage is changed in order to tune the LC resonance circuit in the quadrupole power source in which the frequency-variable tuning method is adopted, a correction process for maintaining the mass-resolving power and for preventing an m/z-axis displacement is automatically performed according to the amount of change in the frequency. Therefore, no adjustment of the mass-peak shape or the m/z-axis by a manual adjustment or automatic tuning of variable resistors is required even when the frequency adjustment for the tuning is performed. Thus, the workload on the operator is reduced, and the efficiency of the analytical work is improved.

BEST MODE FOR CARRYING OUT THE INVENTION

First Embodiment

A quadrupole mass spectrometer as one embodiment of the present invention (which is called the "first embodiment") is hereinafter described in detail with reference to the attached drawings.

Figure 1:
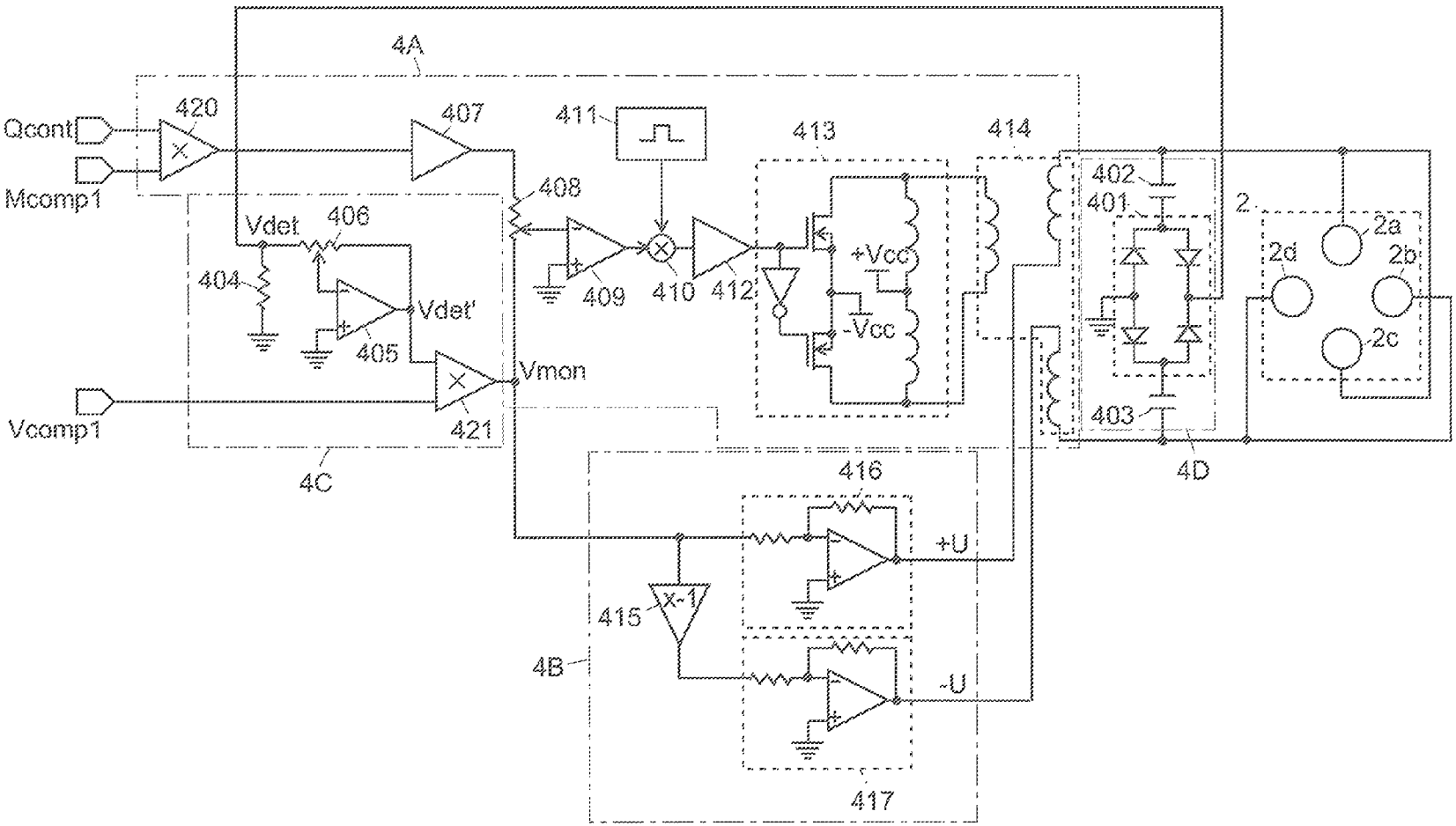
FIG. 1 is a circuit configuration diagram of a quadrupole power source in a quadrupole mass spectrometer as the first embodiment of the present invention.
Figure 6:
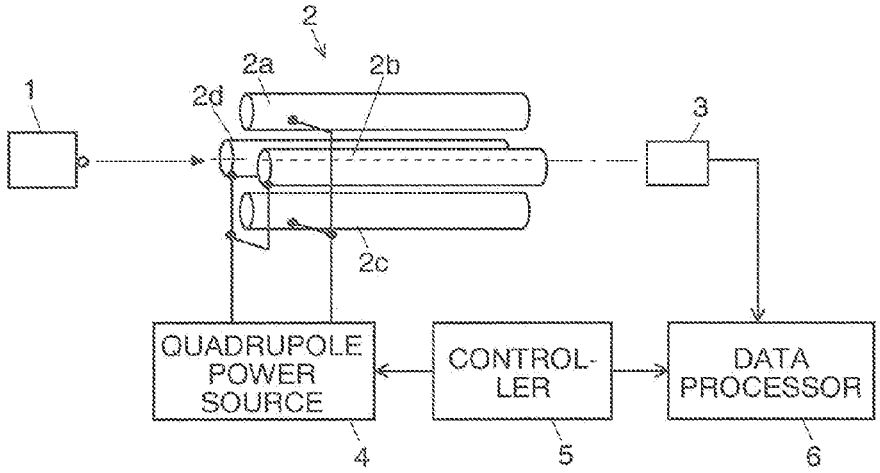
FIG. 6 is a schematic configuration diagram of a commonly used quadrupole mass spectrometer.
Figure 7:
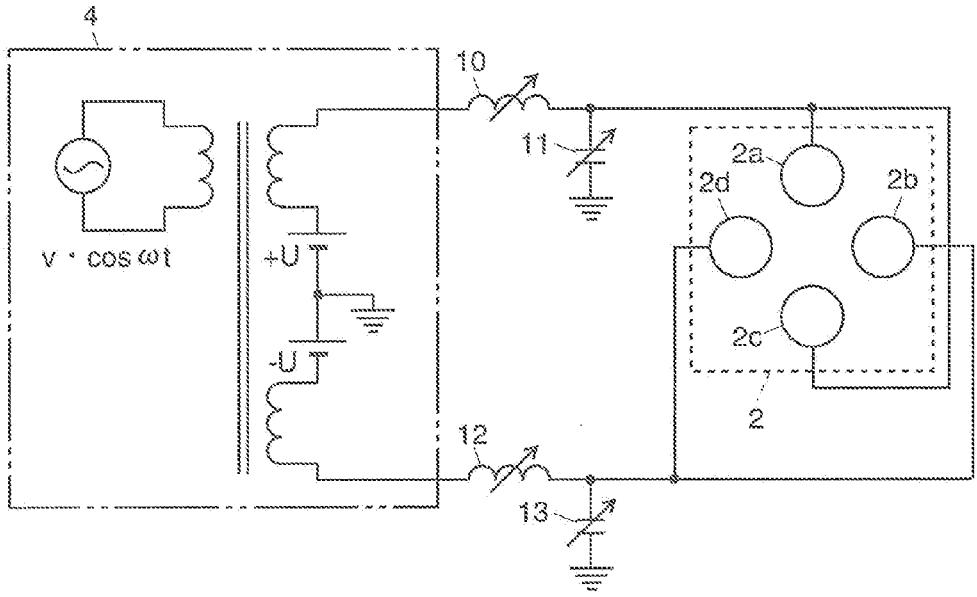
FIG. 7 is a schematic block diagram of a conventional quadrupole power source.
Figure 8:
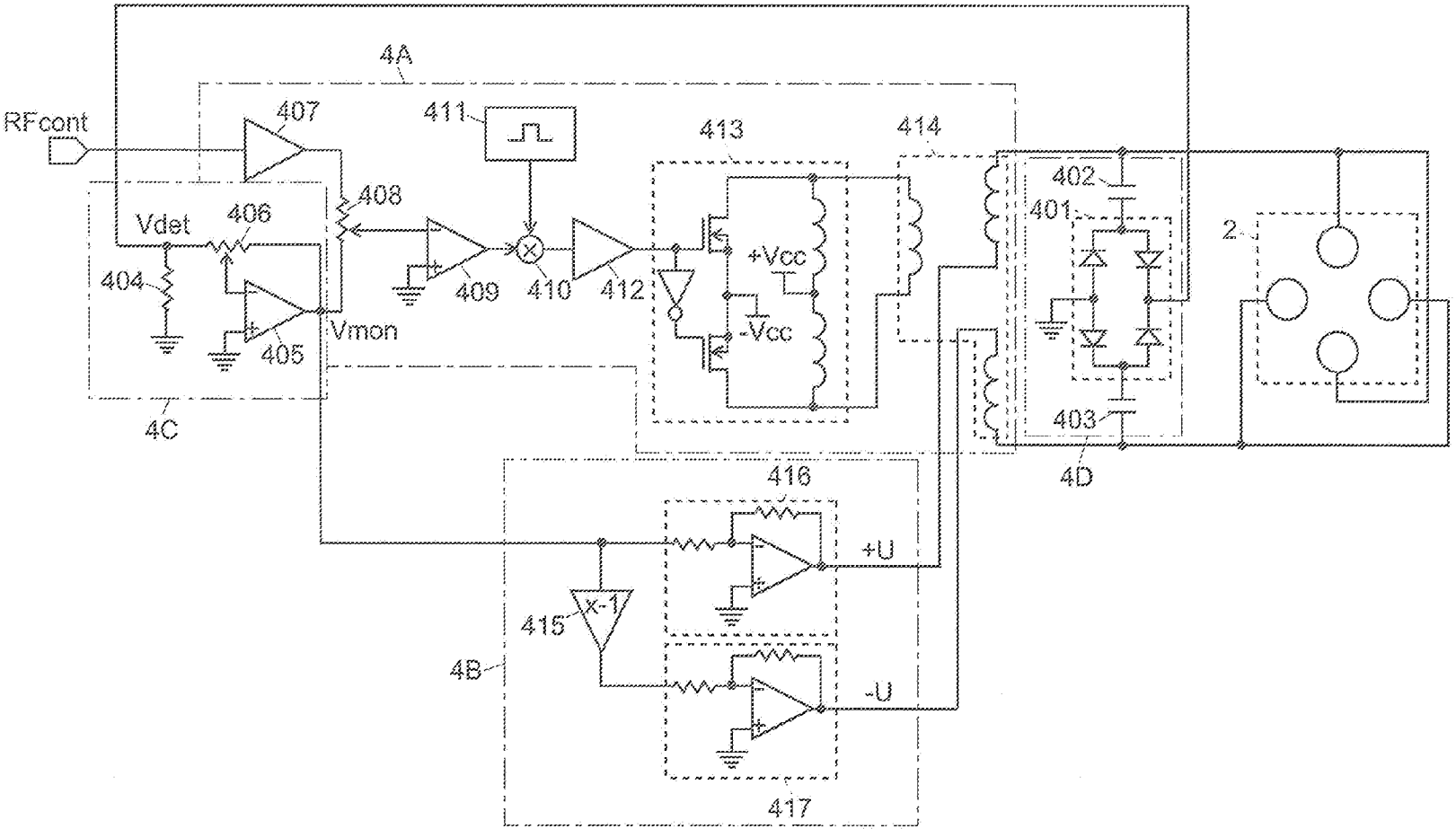
FIG. 8 is a circuit configuration diagram of a conventional quadrupole power source.
Figure 9A:
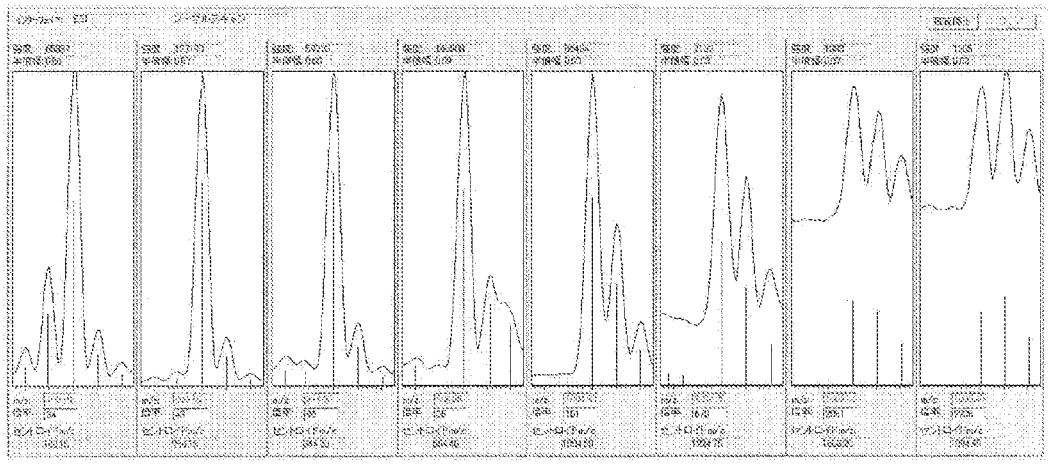
FIGS. 9A and 9B are examples of peak profiles actually measured at a plurality of mass-to-charge ratios for a standard sample.
Figure 9B:
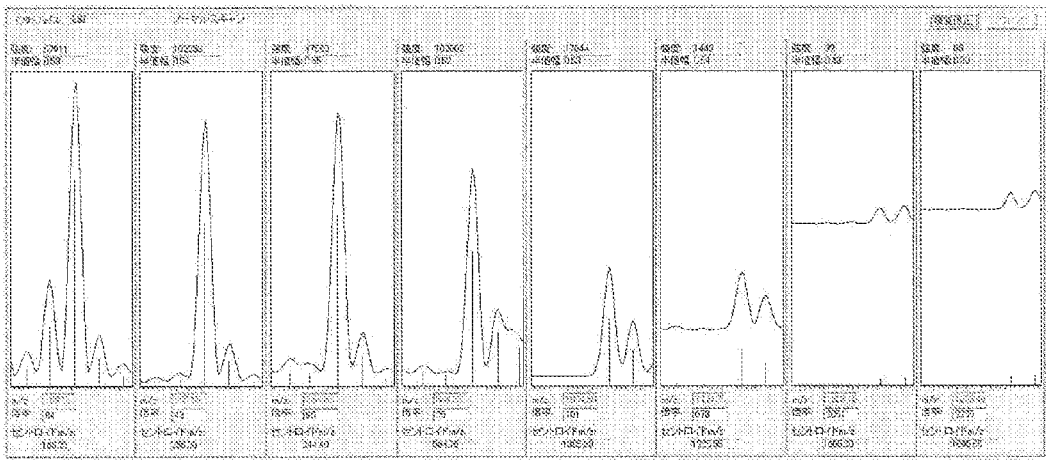
Figure 10A:
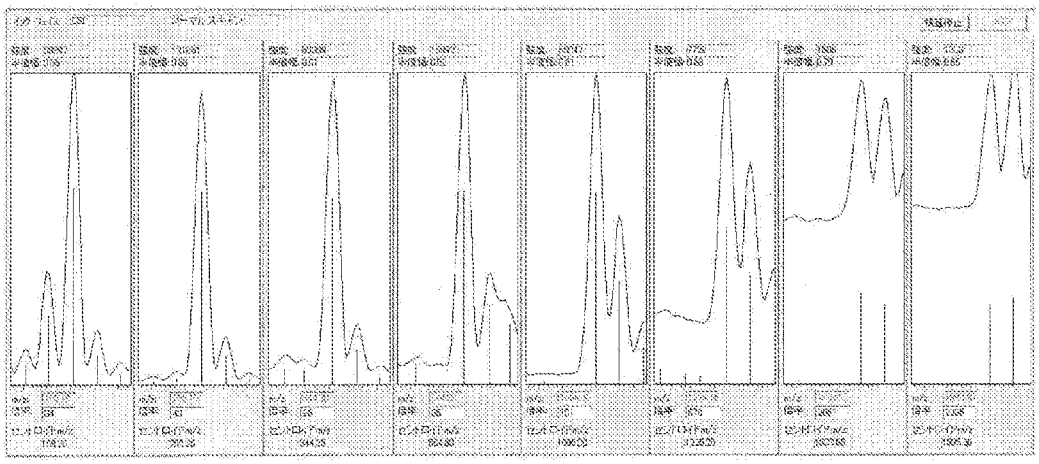
FIGS. 10A and 10B are examples of peak profiles actually measured at a plurality of mass-to-charge ratios for a standard sample.
Figure 10B:
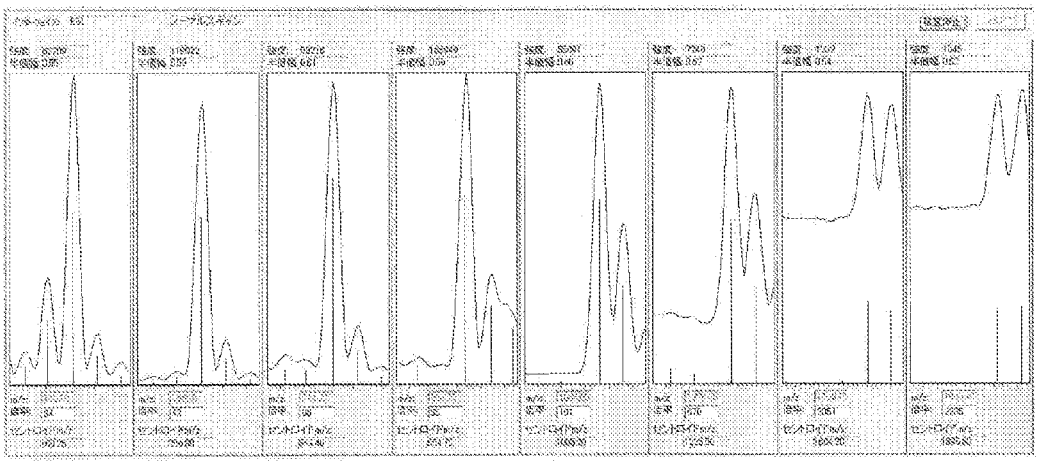

The overall configuration of the quadrupole mass spectrometer of the first embodiment is the same as that of the conventional system shown in FIG. 6 and hence will not be described. A feature of the quadrupole mass spectrometer of the first embodiment exists in the circuit configuration of the quadrupole power source 4. FIG. 1 is a circuit configuration diagram of the quadrupole power source 4 in the quadrupole mass spectrometer of the first embodiment. In this figure, the same components as already described with reference to FIG. 8 are denoted by the same numerals and will not be specifically described.

In the first embodiment, an m/z-axis correction coefficient Mcomp1 and a V-voltage correction coefficient Vcomp1 are fed from the controller 5 to the quadrupole power source 4 in addition to the power supply controlling voltage Qcont. The quadrupole power source 4 has a V-voltage correcting function and an m/z-axis correcting function.

The V-voltage correcting function, which is added to the detection gain adjuster section 4C, is realized by a multiplier 421 which multiplies the output Vdet' of the V-voltage adjusting amplifier 405 by the V-voltage correction coefficient Vcomp1. The V-voltage correction coefficient Vcomp1 is determined according to the set frequency f (the actual oscillation frequency) used in the RF voltage signal generator 411. Specifically, Vcomp1=(standard frequency $f_0$/set frequency f), i.e. the reciprocal of the ratio by which the frequency is changed. Accordingly, if the set frequency f is changed, the overall gain of the detection gain adjuster section 4C changes according to the V-voltage correction coefficient Vcomp1 multiplied in the multiplier 421. By this feedback operation, the V-voltage monitoring voltage Vmon is constantly maintained at the same level regardless of how the set frequency f changes. For example, when the set frequency f is increased and the overall gain of the detection gain adjuster section 4C is decreased, the feedback operation for increasing the V voltage to cancel the decrease in the gain will be performed. As already explained, if no V-voltage correction is performed, increasing the set frequency f would decrease the V voltage. The V-voltage correcting function increases the V voltage so as to cancel this decrease, so that the V voltage is maintained at the same level as before the change in the set frequency f.

A specific example is as follows: If there is no V-voltage correcting function, provided that the standard frequency $f_0$=1.2 MHz and the set frequency is f=1.20024 MHz, the V voltage at f=1.20024 MHz is:

$$V\text{ voltage (at 1.20024 MHz)}=V\text{ voltage (at 1.2 MHz)}\times(1.2\text{ MHz}/1.20024\text{ MHz}).$$

If the V-voltage correction is performed by the multiplier 421, $$V\text{comp1}\cdot V\text{def}=V\text{mon (constant)},$$

therefore, $$V\text{ voltage (at 1.20024 MHz)} = V\text{ voltage (at 1.2 MHz)}\times(1.2\text{ MHz}/1.20024\text{ MHz})/V\text{comp1} = V\text{ voltage (at 1.2 MHz)}\times(1.2\text{ MHz}/1.20024\text{ MHz})/(1.2\text{ MHz}/1.20024\text{ MHz}) = V\text{ voltage (at 1.2 MHz)}.$$

Thus, the V voltage is maintained at the same level even when the frequency of the RF voltage is changed from 1.2 MHz to 1.20024 MHz.

The m/z-axis correcting function, which is added to the RF power supply section 4A, is realized by a multiplier 420 which multiplies the power supply controlling voltage Qcont by the m/z-axis correction coefficient Mcomp1. The m/z-axis correction coefficient Mcomp1 is also determined according to the set frequency f. Specifically, Mcomp1=(set frequency f/standard frequency $f_0)^2$, i.e. the square of the ratio by which the frequency is changed. As already explained, according to the Mathieu equation, when the frequency f of the RF voltage is changed, the optimal voltage for an arbitrary mass-to-charge ratio must be changed by a ratio equal to the square of the frequency change. In the multiplier 420, the power supply controlling voltage Qcont is changed by a ratio equal to the square of the frequency change, making the V voltage optimal for any mass-to-charge ratio. Thus, no displacement of the m/z axis occurs even when the set frequency f is changed.

If there is no m/z-axis correcting function, the V voltage at a set frequency f=1.20024 MHz is:

$$V\text{ voltage (at 1.20024 MHz)}=V\text{ voltage (at 1.2 MHz)},$$

whereas the V optimal voltage for any mass-to-charge ratio at the frequency f=1.20024 MHz is:

$$V\text{ voltage (at 1.20024 MHz)}=V\text{ voltage (at 1.2 MHz)}\times(1.20024\text{ MHz}/1.2\text{ MHz})^2.$$

Thus, a discrepancy occurs between the output voltage and the optimal voltage, which means that the m/z axis is displaced. By contrast, if the previously described m/z-axis correction by the multiplier 420 is performed, $$V\text{ voltage (at 1.20024 MHz)}=Q\text{cont}\times M\text{comp1}=V\text{ voltage (at 1.2 MHz)}\times(1.20024\text{ MHz}/1.2\text{ MHz})^2.$$

Thus, even when the frequency of the RF voltage is changed from 1.2 MHz to 1.20024 MHz, the V voltage becomes the optimal voltage for any mass-to-charge ratio, i.e. the voltage which causes no displacement of the m/z axis.

In summary, in the quadrupole mass spectrometer of the first embodiment, when changing the set frequency f of the RF voltage signal generator 411 from the standard frequency $f_0$ in order to tune the LC resonance circuit, the controller 5 calculates the V-voltage correction coefficient Vcomp1= (standard frequency $f_0$/set frequency f) and the m/z-axis correction coefficient Mcomp1=(set frequency f/standard frequency $f_0)^2$, and gives these coefficients to the quadrupole power source 4. Upon receiving these coefficients, the quadrupole power source 4 corrects the detection output voltage and the power supply controlling voltage in the previously described manner. By this operation, even after the set frequency f is changed, the mass-resolving power is maintained at a high level, and no displacement of the m/z axis occurs.

The multipliers 420 and 421 in the configuration of the first embodiment are analogue multipliers. However, it is naturally possible to digitally perform the multiplication on a central processing unit (CPU) or similar device. This also applies in the other embodiments which will be hereinafter described.

Second Embodiment

A quadrupole mass spectrometer as another embodiment of the present invention (which is called the "second embodiment") is hereinafter described in detail with reference to the attached drawings.

Figure 2:
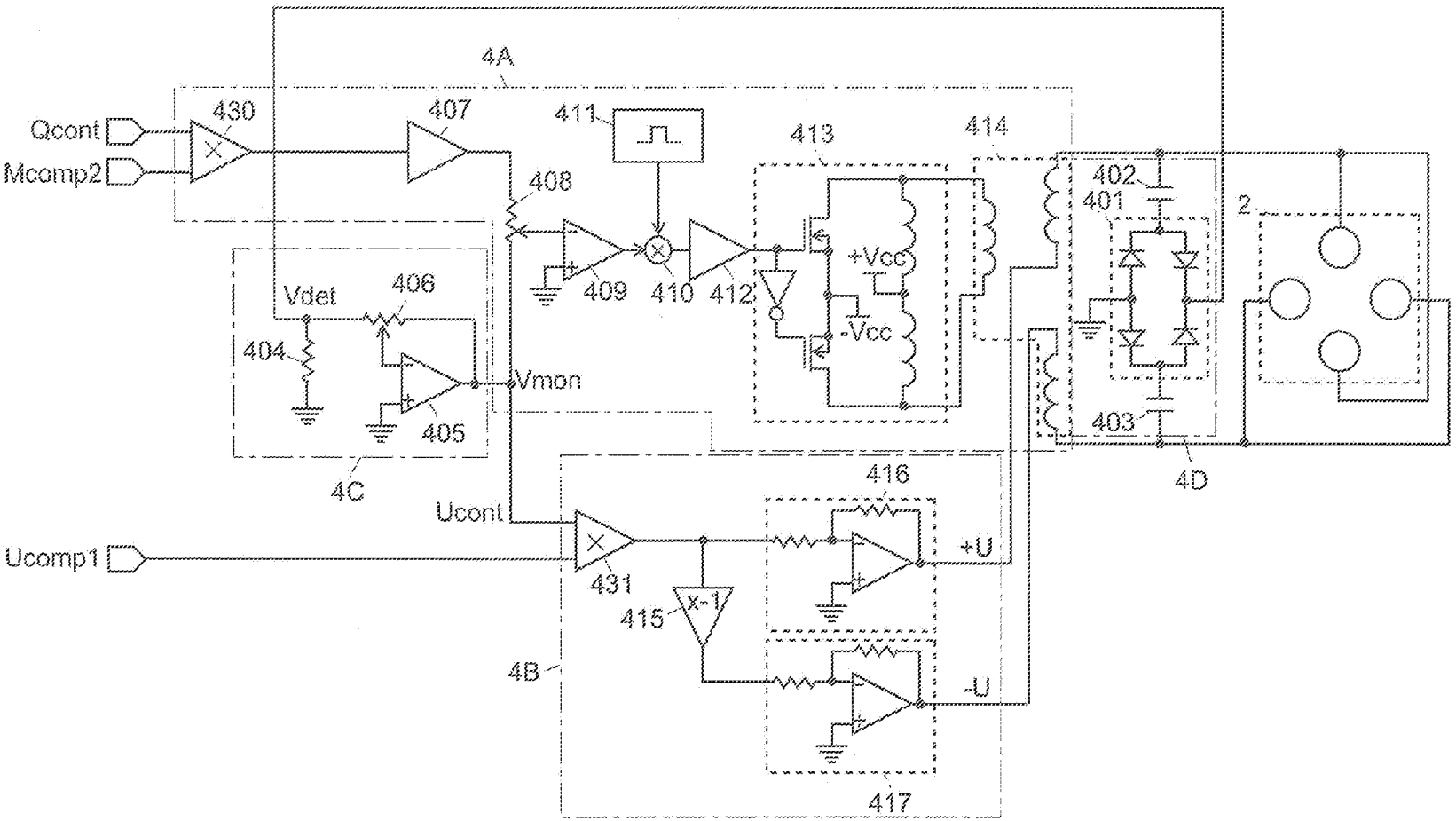
FIG. 2 is a circuit configuration diagram of a quadrupole power source in a quadrupole mass spectrometer as the second embodiment of the present invention.

FIG. 2 is a circuit configuration diagram of the quadrupole power source 4 in the quadrupole mass spectrometer of the second embodiment. In this figure, the same components as already described with reference to FIG. 1 or 8 are denoted by the same numerals and will not be specifically described.

In the quadrupole mass spectrometer of the second embodiment, a U-voltage correcting function is added to the DC power supply section 4B in place of the V-voltage correcting function provided in the system of the first embodiment. The U-voltage correcting function added to the DC power supply section 4B is designed to produce substantially the same effect as the V-voltage correction by changing the U voltage so as to maintain the ratio between the V voltage and the U voltage for a change in the V voltage resulting from a change in the set frequency f. Specifically, the U-voltage correcting function is realized by a multiplier 431 which multiplies the U-voltage controlling voltage Ucont (=Vmon) fed from the detection gain adjuster section 4C to the DC power supply section 4B by a U-voltage correction coefficient Ucomp1 determined according to the set frequency f. This correction coefficient is Ucomp1=(standard frequency $f_0$/set frequency f). By this correction, the ratio between the V voltage and the U voltage is maintained at the same value even when the set frequency f is changed.

For example, if there is no U-voltage correcting function, provided that the standard frequency $f_0$=1.2 MHz and the set frequency is f=1.20024 MHz, the V voltage at f=1.20024 MHz is:

$$V\text{ voltage (at 1.20024 MHz)}=V\text{ voltage (at 1.2 MHz)}\times(1.2\text{ MHz}/1.20024\text{ MHz}).$$

Since $$Ucont = Vmon = constant,$$

the following equation holds true:

$$U\ \text{voltage (at 1.2 MHz)} - U\ \text{voltage (at 1.20024 MHz)}.$$

Therefore, the ratio between the V voltage and the U voltage is:

$$V\ \text{voltage}/U\ \text{voltage (at 1.20024 MHz)} = [V\ \text{voltage (at 1.2 MHz)} \times (1.2\ \text{MHz}/1.20024\ \text{MHz})]/U\ \text{voltage (at 1.2 MHz)} = [V\ \text{voltage}/U\ \text{voltage (at 1.2 MHz)}] \times (1.2\ \text{MHz}/1.20024\ \text{MHz}).$$

Thus, the ratio between the V voltage and the U voltage changes with the frequency change.

By contrast, if the previously described U-voltage correction by the multiplier 422 is performed, $$U\ \text{voltage (at 1.20024 MHz)} = U\ \text{voltage (at 1.2 MHz)}/Ucomp1 = U\ \text{voltage (at 1.2 MHz)}/(1.2\ \text{MHz}/1.20024\ \text{MHz}).$$

Therefore, the ratio between the V voltage and the U voltage is:

$$V\ \text{voltage}/U\ \text{voltage (at 1.20024 MHz)} = [V\ \text{voltage (at 1.2 MHz)} \times (1.2\ \text{MHz}/1.20024\ \text{MHz})]/[U\ \text{voltage (at 1.2 MHz)} \times (1.2\ \text{MHz}/1.20024\ \text{MHz})] = V\ \text{voltage}/U\ \text{voltage (at 1.2 MHz)}.$$

Thus, the ratio between the V voltage and the U voltage is maintained at the same value even when the frequency is changed from 1.2 MHz to 1.20024 MHz.

The m/z-axis correcting function provided in the RF power supply section 4A is realized by a multiplier 430 which multiplies the power supply controlling voltage Qcont by the m/z-axis correction coefficient Mcomp2. The m/z-axis correction coefficient Mcomp2 is determined according to the set frequency f. Specifically, Mcomp2=(set frequency f/standard frequency $f_0$)$^3$. By this correction, the displacement of the m/z axis can be prevented even when the set frequency f is changed.

For example, consider the case where there is no m/z-axis correcting function. As described in the first embodiment, the V voltage at a set frequency f=1.20024 MHz is:

$$V\ \text{voltage (at 1.20024 MHz)} = V\ \text{voltage (at 1.2 MHz)},$$

whereas the V optimal voltage for any mass-to-charge ratio at a frequency f=1.20024 MHz is:

$$V\ \text{voltage (at 1.20024 MHz)} = V\ \text{voltage (at 1.2 MHz)} \times (1.20024\ \text{MHz}/1.2\ \text{MHz})^2.$$

Thus, a discrepancy occurs between the output voltage and the optimal voltage, which means that the m/z axis is displaced. By contrast, if the m/z-axis correction by the multiplier 430 is performed, $$V\ \text{voltage (at 1.20024 MHz)} =$$

-continued $$Qcont \times Mcomp2 = V\ \text{voltage (at 1.2 MHz)} \times (1.2\ \text{MHz}/1.20024\ \text{MHz}) \times (1.20024\ \text{MHz}/1.2\ \text{MHz})^3 = V\ \text{voltage (at 1.2 MHz)} \times (1.20024\ \text{MHz}/1.2\ \text{MHz})^2.$$

Thus, even when the frequency of the RF voltage is changed from 1.2 MHz to 1.20024 MHz, the V voltage becomes the optimal voltage for any mass-to-charge ratio, i.e. the voltage which causes no displacement of the m/z axis.

In summary, in the quadrupole mass spectrometer of the second embodiment, when changing the set frequency f of the RF voltage signal generator 411 from the standard frequency $f_0$ in order to tune the LC resonance circuit, the controller 5 calculates the U-voltage correction coefficient Ucomp1=(standard frequency $f_0$/set frequency f) and the m/z-axis correction coefficient Mcomp2=(set frequency f/standard frequency $f_0$)$^3$, and gives these coefficients to the quadrupole power source 4. Upon receiving these coefficients, the quadrupole power source 4 corrects the U-voltage controlling voltage fed to the DC power supply section 4B and the power supply controlling voltage in the previously described manner. By this operation, even after the set frequency f is changed, the mass-resolving power is maintained at a high level, and no displacement of the m/z axis occurs.

Third Embodiment

A quadrupole mass spectrometer as another embodiment of the present invention (which is called the "third embodiment") is hereinafter described in detail with reference to the attached drawings.

Figure 3:
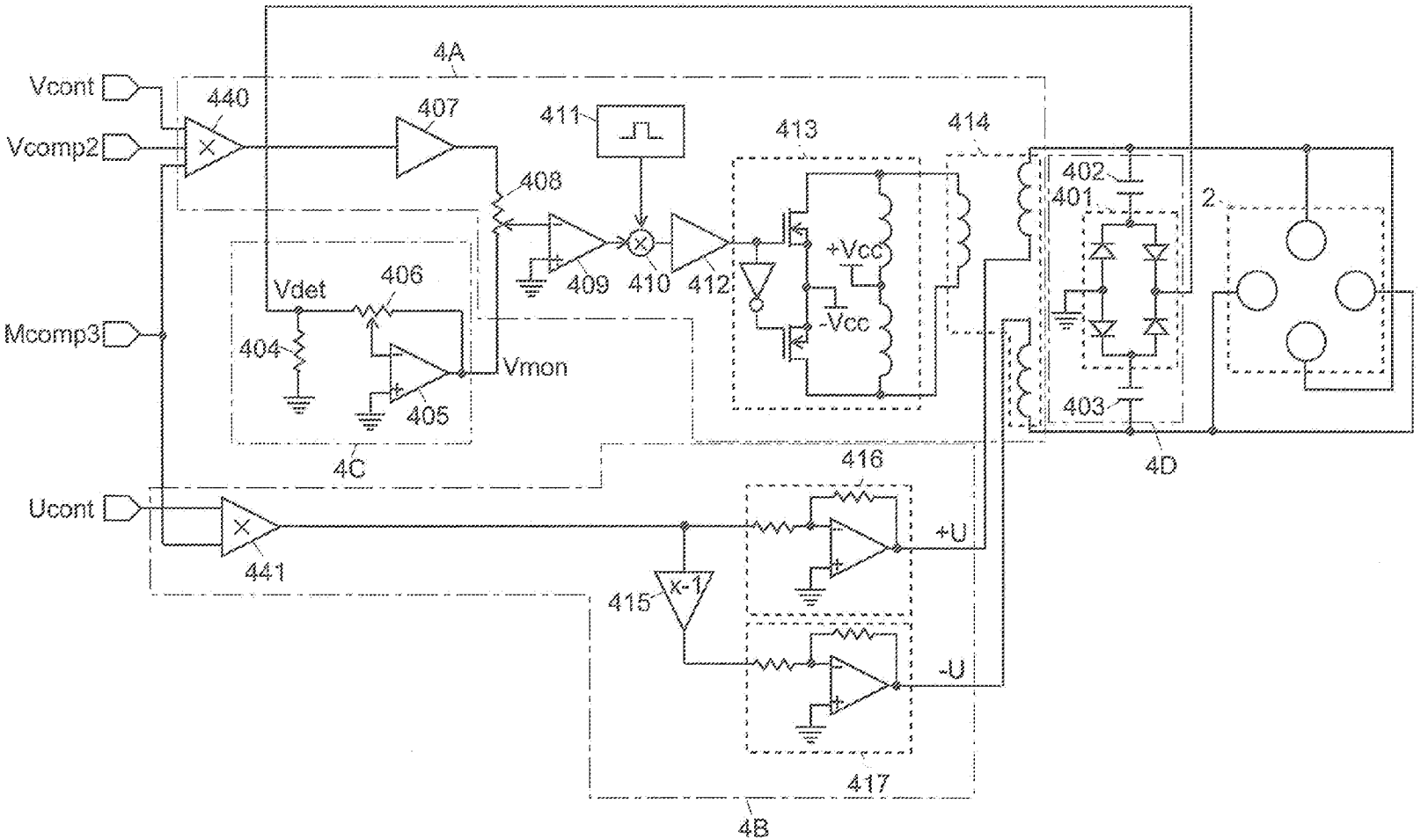
FIG. 3 is a circuit configuration diagram of a quadrupole power source in a quadrupole mass spectrometer as the third embodiment of the present invention.

FIG. 3 is a circuit configuration diagram of the quadrupole power source 4 in the quadrupole mass spectrometer of the third embodiment. In this figure, the same components as already described with reference to FIG. 1, 2 or 8 are denoted by the same numerals and will not be specifically described.

In the configurations of the first and second embodiments, the V-voltage monitoring voltage Vmon produced by the detection gain adjuster section 4C is used as the U-voltage controlling voltage fed to the DC power supply section 4B. In the configuration of any of the third and subsequent embodiments, a U-voltage controlling voltage dedicated to the DC power supply section 4B is given to the quadrupole power source 4, and the quadrupole power source 4 produces a DC voltage using that voltage.

In the configuration of the third embodiment, a V-voltage controlling voltage Vcont given from the controller 5 undergoes a V-voltage correction and an m/z-axis correction in the RF power supply section 4A, while a U-voltage controlling voltage Ucont given from the controller 5 undergoes an m/z-axis correction in the DC power supply section 4B. The V-voltage correcting function is realized by a multiplier 440 which multiplies the V-voltage controlling voltage Vcont by a V-voltage correction coefficient Vcomp2 determined according to the set frequency f. Specifically, the V-voltage correction coefficient is Vcomp2=(set frequency f/standard frequency $f_0$). By this correction, the V voltage is maintained at the same level even when the set frequency f is changed.

The m/z-axis correcting function is realized by a multiplier 440 in the RF power supply section 4A which multiplies the V-voltage controlling voltage Vcont by an m/z-axis correction coefficient Mcomp3 determined according to the set frequency f and a multiplier 441 in the DC power supply section 4B which multiplies the U-voltage controlling voltage Ucont by the m/z-axis correction coefficient Mcomp3.

The m/z-axis correction coefficient is Mcomp3=(set frequency f/standard frequency $f_0)^2$. The multiplier 440 multiplies the V-voltage controlling voltage Vcont by both the V-voltage correction coefficient Vcomp2 and the m/z-axis correction coefficient Mcomp3. Accordingly, the multiplier 440 actually multiplies the V-voltage controlling voltage Vcont by the coefficient of (set frequency f/standard frequency $f_0)^3$. By this correction, as in the first and second embodiments, a high mass-resolving power is maintained and the accuracy of the m/z axis is also maintained even after the set frequency f is changed.

Fourth Embodiment

A quadrupole mass spectrometer as another embodiment of the present invention (which is called the "fourth embodiment") is hereinafter described in detail with reference to the attached drawings.

Figure 4:
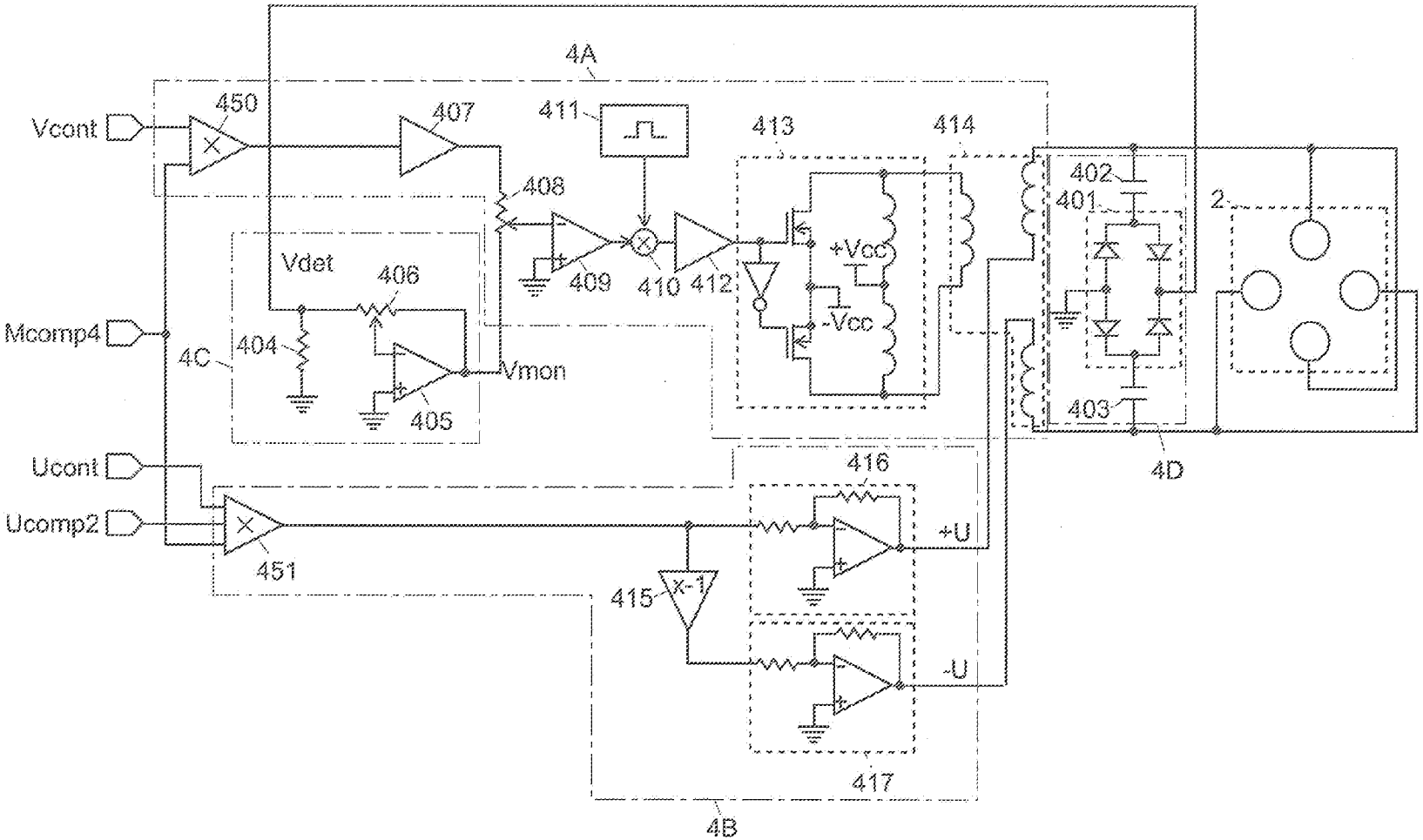
FIG. 4 is a circuit configuration diagram of a quadrupole power source in a quadrupole mass spectrometer as the fourth embodiment of the present invention.

FIG. 4 is a circuit configuration diagram of the quadrupole power source 4 in the quadrupole mass spectrometer of the fourth embodiment. In this figure, the same components as already described with reference to FIGS. 1 through 3 or 8 are denoted by the same numerals and will not be specifically described.

In the configuration of the fourth embodiment, a U-voltage controlling voltage Ucont given from the controller 5 undergoes a U-voltage correction and an m/z-axis correction in the DC power supply section 4B, while a V-voltage controlling voltage Vcont given from the controller 5 undergoes an m/z-axis correction in the RF power supply section 4A. The U-voltage correcting function is realized by a multiplier 451 which multiplies the U-voltage controlling voltage Ucont by a U-voltage correction coefficient Ucomp2 determined according to the set frequency f. Specifically, the U-voltage correction coefficient is Ucomp2=(standard frequency $f_0$/set frequency f). By this correction, the ratio between the V voltage and the U voltage is maintained at the same value even when the set frequency f is changed.

The m/z-axis correcting function is realized by a multiplier 450 in the RF power supply section 4A which multiplies the V-voltage controlling voltage Vcont by an m/z-axis correction coefficient Mcomp4 determined according to the set frequency f and a multiplier 451 in the DC power supply section 4B which multiplies the U-voltage controlling voltage Ucont by the m/z-axis correction coefficient Mcomp4. The m/z-axis correction coefficient is Mcomp4=(set frequency f/standard frequency $f_0)^3$. The multiplier 451 multiplies the U-voltage controlling voltage Ucont by both the U-voltage correction coefficient Ucomp2 and the m/z-axis correction coefficient Mcomp4. Accordingly, the multiplier 451 actually multiplies the U-voltage controlling voltage Ucont by the coefficient of (set frequency f/standard frequency $f_0)^2$. By this correction, as in the first and second embodiments, a high mass-resolving power is maintained and the accuracy of the m/z axis is also maintained even after the set frequency f is changed.

Fifth Embodiment

A quadrupole mass spectrometer as another embodiment of the present invention (which is called the "fifth embodiment") is hereinafter described in detail with reference to the attached drawings.

Figure 5:
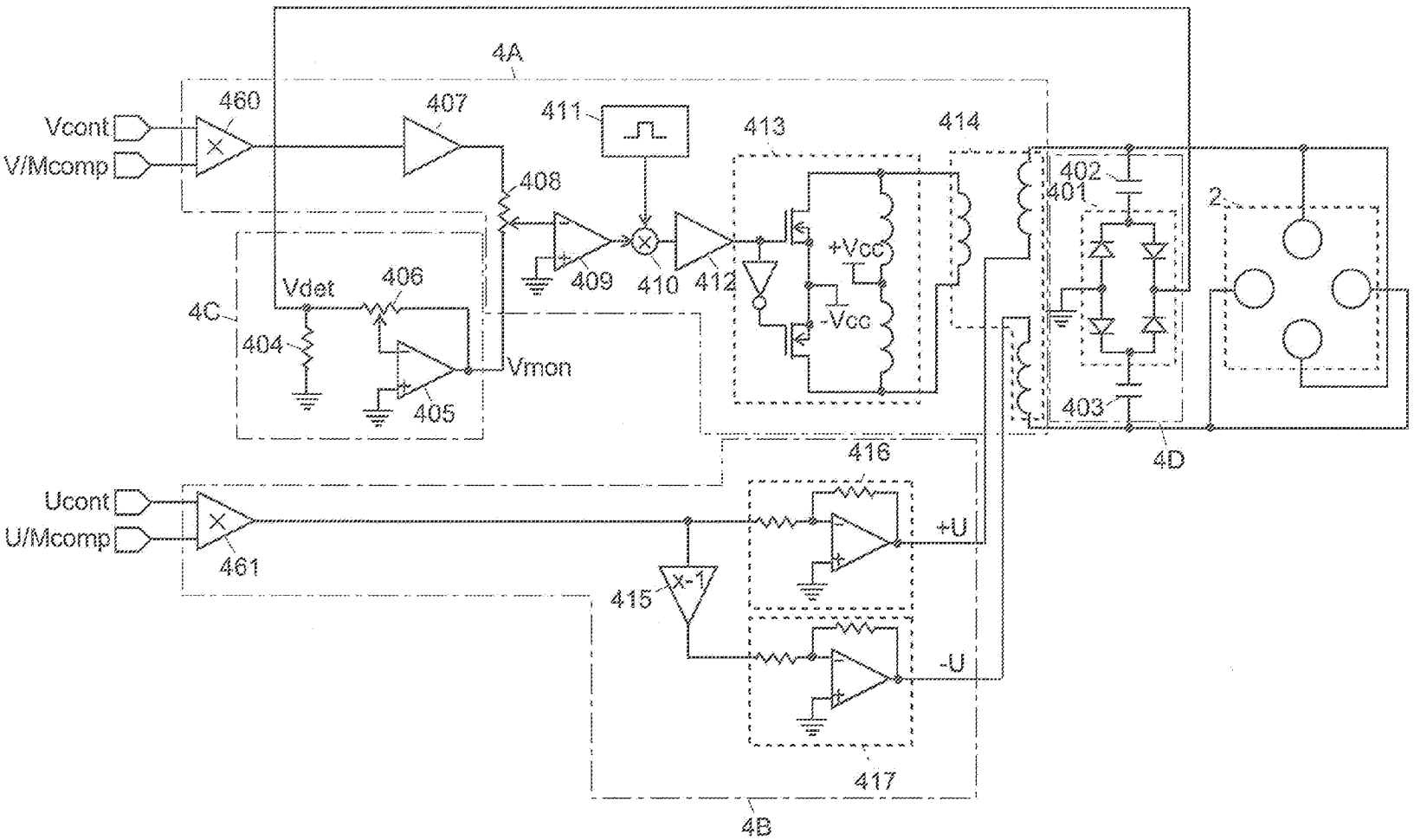
FIG. 5 is a circuit configuration diagram of a quadrupole power source in a quadrupole mass spectrometer as the fifth embodiment of the present invention.

FIG. 5 is a circuit configuration diagram of the quadrupole power source 4 in the quadrupole mass spectrometer of the fifth embodiment. In this figure, the same components as already described with reference to FIGS. 1 through 4 or 8 are denoted by the same numerals and will not be specifically described.

In the configuration of the fifth embodiment, a U-voltage controlling voltage Ucont given from the controller 5 undergoes a U-voltage correction and an m/z-axis correction in the DC power supply section 4B, while a V-voltage controlling voltage Vcont given from the controller 5 also undergoes a V-voltage correction and an m/z-axis correction in the RF power supply section 4A. In the present embodiment, in order to perform both the U-voltage correction and the m/z axis correction, a multiplier 461 multiplies the U-voltage controlling voltage Ucont by a U-voltage-and-m/z-axis correction coefficient U/Mcomp. Specifically, this coefficient is U/Mcomp=(set frequency f/standard frequency $f_0)^2$. Furthermore, in order to perform both the V-voltage correction and the m/z axis correction, a multiplier 460 multiplies the V-voltage controlling voltage Vcont by a V-voltage-and-m/z-axis correction coefficient V/Mcomp. Specifically, this coefficient is V/Mcomp=(set frequency f/standard frequency $f_0)^3$.

By this correction, as in the first and second embodiments, a high mass-resolving power is maintained and the accuracy of the m/z axis is also maintained even after the set frequency f is changed.

As described thus far, in the quadrupole mass spectrometer according to the present invention, when the frequency is changed so as to tune the LC resonance circuit including the rod electrodes of the quadrupole mass filter 2 and apply a high-amplitude RF voltage to the quadrupole mass filter 2, the correction of the voltages according to the frequency change arise automatically performed in the quadrupole power source 4. Therefore, it is unnecessary to adjust the mass-resolving power or correct the m/z-axis displacement by a manual adjustment of the variable resistors 406, 408 or other operations.

It should be noted that the previous embodiments are mere examples of the present invention, and any change, modification or addition appropriately made within the spirit of the present invention will evidently fall within the scope of claims of the present patent application.

EXPLANATION OF NUMERALS

1 . . . Ion Source
2 . . . Quadrupole Mass Filter
2*a*, 2*b*, 2*c*, 2*d* . . . Rod Electrode
3 . . . Detector
4 . . . Quadrupole Power Source
4A . . . Radio-Frequency Power Supply Section
4B . . . Direct-Current Power Supply Section
4C . . . Detection Gain Adjuster Section
4D . . . Wave Detector Section
401 . . . Diode Bridge Rectifier Circuit
402, 403 . . . Detecting Capacitor
404 . . . V-Voltage Detecting Resistor
405 . . . V-Voltage Adjusting Amplifier
406 . . . V-Voltage Adjusting Variable Resistor
407 . . . Buffer Amplifier
408 . . . m/z-Axis Adjusting Variable Resistor
409 . . . V-Voltage Comparing Amplifier
410 . . . Multiplier
411 . . . Radio-Frequency Voltage Signal Generator
412 . . . Buffer Amplifier
413 . . . Drive Circuit
414 . . . Radio-Frequency Transformer
415 . . . Inverting Amplifier
416 . . . Positive Direct-Current Voltage Amplifier

417 . . . Negative Direct-Current Voltage Amplifier
420, 421, 430,431, 440, 441, 450, 451, 460, 461 . . . Multiplier
5 . . . Controller
6 . . . Data Processor
10 . . . Coil
11 . . . Capacitor

The invention claimed is:

1. A quadrupole mass spectrometer including a quadrupole mass filter composed of a plurality of electrodes, a quadrupole power source for applying a predetermined voltage to each of the electrodes of the quadrupole mass filter so as to selectively allow an ion having a specific mass-to-charge ratio to pass through the quadrupole mass filter, and a controller for giving the quadrupole power source an instruction on a target voltage corresponding to the mass-to-charge ratio of a target ion, the quadrupole power source having a wave detector for detecting a radio-frequency voltage applied to the quadrupole mass filter and generating a DC detection output, a detection output adjuster for adjusting a gain of the detection output generated by the wave detector, a radio-frequency power source which includes a signal generator for generating a radio-frequency signal with a variable frequency and which produces a radio-frequency voltage whose amplitude is based on a comparison between an output of the detection output adjuster and the target voltage and whose frequency is equal to or proportional to the frequency of the radio-frequency signal, a direct-current power source for producing a direct-current voltage based on the output of the detection output adjuster, and a superimposer for superimposing the direct-current voltage produced by the direct-current power source and the radio-frequency voltage produced by the radio-frequency power source, where the radio-frequency voltage superimposed by the superimposer is applied to the quadrupole mass filter after being increased by an LC resonation circuit including, as a component thereof, a stray capacitance between the electrodes of the quadrupole mass filter, and where the LC resonance circuit is tuned by adjusting the frequency of the radio-frequency signal, wherein the detection output adjuster in the quadrupole power source includes an amplifier for amplifying a voltage with a constant gain independent of the frequency of the radio-frequency signal and a first corrector for correcting a voltage at a stage of input to or output from the amplifier according to a ratio of a frequency change so that the radio-frequency voltage applied to the quadrupole mass filter maintains a constant amplitude when the frequency of the radio-frequency signal is changed from a standard frequency for a purpose of tuning, and the quadrupole power source further includes a second corrector for correcting the target voltage according to a square of the ratio of the frequency change when the aforementioned frequency change for the tuning is made.

2. A quadrupole mass spectrometer including a quadrupole mass filter composed of a plurality of electrodes, a quadrupole power source for applying a predetermined voltage to each of the electrodes of the quadrupole mass filter so as to selectively allow an ion having a specific mass-to-charge ratio to pass through the quadrupole mass filter, and a controller for giving the quadrupole power source an instruction on a target voltage corresponding to the mass-to-charge ratio of a target ion, the quadrupole power source having a wave detector for detecting a radio-frequency voltage applied to the quadrupole mass filter and generating a DC detection output, a detection output adjuster for adjusting a gain of the detection output generated by the wave detector, a radio-frequency power source which includes a signal generator for generating a radio-frequency signal with a variable frequency and which produces a radio-frequency voltage whose amplitude is based on a comparison between an output of the detection output adjuster and the target voltage and whose frequency is equal to or proportional to the frequency of the radio-frequency signal, a direct-current power source for producing a direct-current voltage based on the output of the detection output adjuster, and a superimposer for superimposing the direct-current voltage produced by the direct-current power source and the radio-frequency voltage produced by the radio-frequency power source, where the radio-frequency voltage superimposed by the superimposer is applied to the quadrupole mass filter after being increased by an LC resonation circuit including, as a component thereof, a stray capacitance between the electrodes of the quadrupole mass filter, and where the LC resonance circuit is tuned by adjusting the frequency of the radio-frequency signal, wherein the quadrupole power source comprises:

a) a first corrector for correcting an output sent from the detection output adjuster to the direct-current power source according to a ratio of a frequency change so that the ratio between the amplitude of the radio-frequency voltage applied to the quadrupole mass filter and the direct-current voltage is constantly maintained, by changing the output sent from the detection output adjuster to the direct-current power source by an amount corresponding to a change in an output of the radio-frequency power source when the frequency of the radio-frequency signal is changed from a standard frequency for a purpose of tuning; and b) a second corrector for correcting the target voltage according to a cube of the ratio of the frequency change when the aforementioned frequency change for the tuning is made.

3. A quadrupole mass spectrometer including a quadrupole mass filter composed of a plurality of electrodes, a quadrupole power source for applying, to each of the electrodes of the quadrupole mass filter, a predetermined voltage composed of a radio-frequency voltage superimposed on a direct-current voltage so as to selectively allow an ion having a specific mass-to-charge ratio to pass through the quadrupole mass filter, and a controller for giving the quadrupole power source an instruction on a first target voltage relating to an amplitude of the radio-frequency voltage and on a second target voltage relating to the direct-current voltage so that a voltage corresponding to the mass-to-charge ratio of a target ion is applied to the quadrupole mass filter while maintaining a constant relationship between the amplitude of the radio-frequency voltage and the direct-current voltage, the quadrupole power source having a wave detector for detecting a radio-frequency voltage applied to the quadrupole mass filter and generating a DC detection output, a detection output adjuster for adjusting a gain of the detection output generated by the wave detector, a radio-frequency power source which includes a signal generator for generating a radio-frequency signal with a variable frequency and which produces a radio-frequency voltage whose amplitude is based on a comparison between an output of the detection output adjuster and the first target voltage and whose frequency is equal to or proportional to the frequency of the radio-frequency signal, a direct-current power source for producing a direct-current voltage corresponding to the second target voltage, and a superimposer for superimposing the direct-current voltage produced by the direct-current power source and the radio-frequency voltage produced by the radio-frequency power source, where the radio-frequency voltage superimposed by the superimposer is applied to the quadrupole mass filter after being increased by an LC resonation circuit including, as a component thereof, a stray capacitance between the electrodes of the quadrupole mass filter, and where the LC resonance circuit is tuned by adjusting the frequency of the radio-frequency signal, wherein the quadrupole power source comprises:

a) a first corrector for correcting the first target voltage according to a cube of a ratio of a frequency change when the frequency of the radio-frequency signal is changed from a standard frequency for a purpose of tuning; and b) a second corrector for correcting the second target voltage according to a square of the ratio of the frequency change when the aforementioned frequency change for the tuning is made.

* * * * *